US011312099B2

(12) United States Patent
Duignan

(10) Patent No.: US 11,312,099 B2
(45) Date of Patent: Apr. 26, 2022

(54) SYSTEM AND METHOD FOR FOLDING NAPKINS

(71) Applicant: Alphamated, LLC, Kirtland, OH (US)

(72) Inventor: Evan Duignan, Kirtland, OH (US)

( * ) Notice: Subject to any disclaimer, the term of this patent is extended or adjusted under 35 U.S.C. 154(b) by 0 days.

(21) Appl. No.: 16/858,034

(22) Filed: Apr. 24, 2020

(65) Prior Publication Data

US 2020/0361172 A1 Nov. 19, 2020

Related U.S. Application Data

(60) Provisional application No. 62/849,392, filed on May 17, 2019.

(51) Int. Cl.

| | |
|---|---|
| ***B65B 13/20*** | (2006.01) |
| ***B31D 1/04*** | (2006.01) |
| ***A47G 11/00*** | (2006.01) |
| *B65B 13/18* | (2006.01) |
| *B65B 63/04* | (2006.01) |

(52) U.S. Cl.
CPC ..... *B31D 1/04* (2013.01); *A47G 11/001* (2013.01); *B65B 13/185* (2013.01); *B65B 13/186* (2013.01); *B65B 13/20* (2013.01); *B65B 63/04* (2013.01)

(58) Field of Classification Search
None
See application file for complete search history.

(56) References Cited

U.S. PATENT DOCUMENTS 5,469,688 A * 11/1995 Dunbar ..... B65B 63/04 53/419
2008/0302066 A1* 12/2008 Lavi ..... B65B 11/56 53/399

* cited by examiner

*Primary Examiner* — Alexander S Thomas
(74) *Attorney, Agent, or Firm* — Jason H. Foster; Kremblas & Foster

(57) ABSTRACT

An apparatus includes a platform having an upper surface configured to support a napkin overlying the upper surface, and also having a cavity recessed from the upper surface. Means are provided for applying vacuum pressure in the slot to draw a napkin downward from the upper surface into the cavity, and for rolling the napkin in the cavity.

5 Claims, 7 Drawing Sheets

SYSTEM AND METHOD FOR FOLDING NAPKINS

RELATED APPLICATIONS

This application claims priority to provisional U.S. Patent Application 62/849,392, filed May 17, 2019, which is incorporated by reference in its entirety.

TECHNICAL FIELD

This technology relates to systems and methods for folding napkins around silverware.

BACKGROUND

A table setting of silverware for use by an individual diner is often wrapped in a napkin.

SUMMARY

An apparatus includes a platform having an upper surface configured to support a napkin overlying the upper surface, and also having a cavity recessed from the upper surface. Means are provided for applying vacuum pressure in the slot to draw a napkin downward from the upper surface into the cavity, and for rolling the napkin in the cavity.

DESCRIPTION

Figure 1:
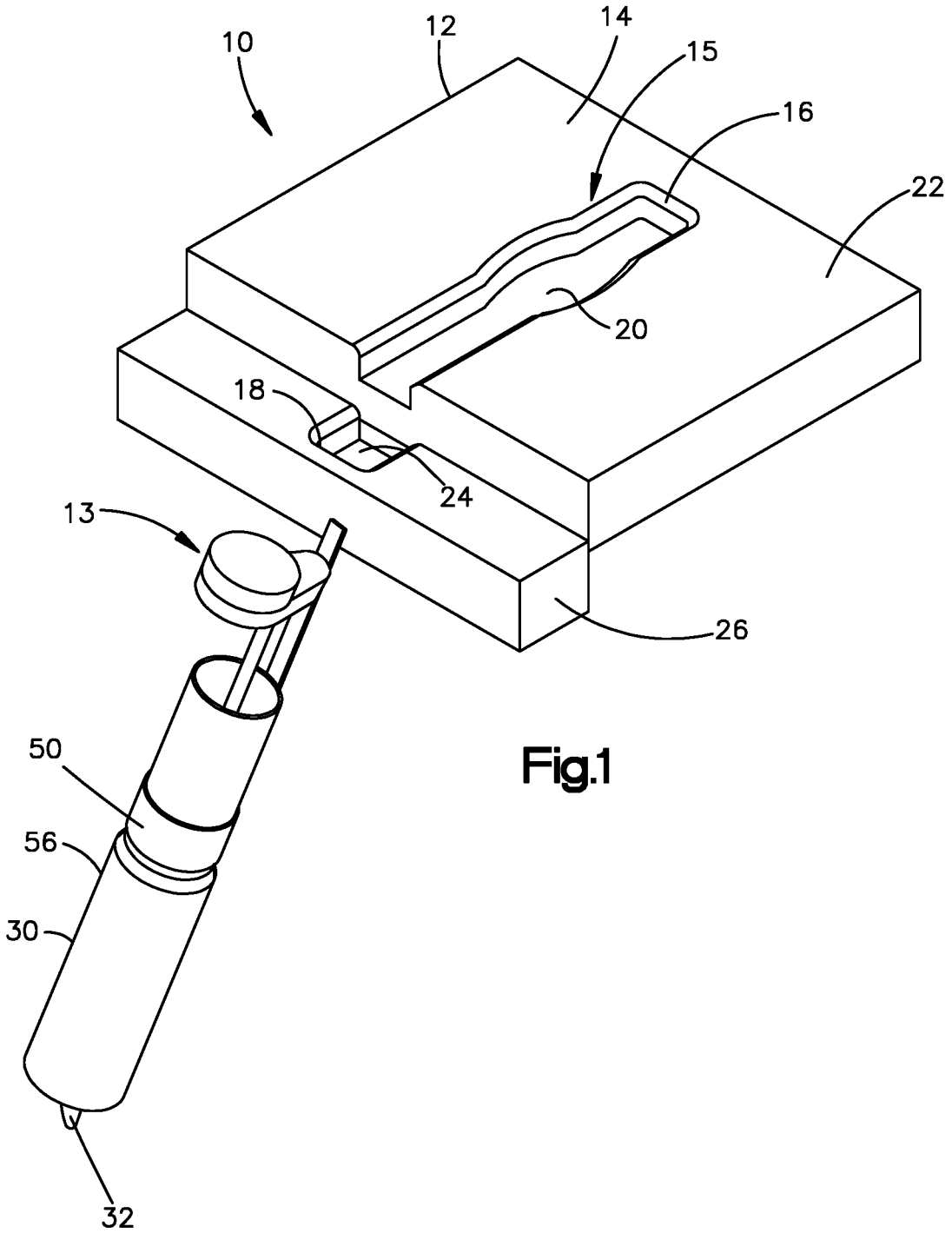
FIG. 1 is a perspective view of an apparatus for folding a napkin around silverware.

An apparatus 10 for rolling a napkin around silverware is shown in FIG. 1. In the given example, the apparatus 10 includes a platform 12 and a motorized rolling device 13. The platform 12 has an upper surface 14. A slot 15 is recessed from the upper surface 14. The slot 15 is closed at its opposite ends 16 and 18. A major length section 20 of the slot 15 is defined by a first portion 22 of the platform 12. A minor length section 24 of the slot 15 is defined by a second portion 26 of the platform 12. The second portion 26 of the platform 12 is movable into and out of a closed position, as shown in FIG. 2-8, in which the slot 15 is continuous between the opposite ends 16 and 18.

Figure 2:
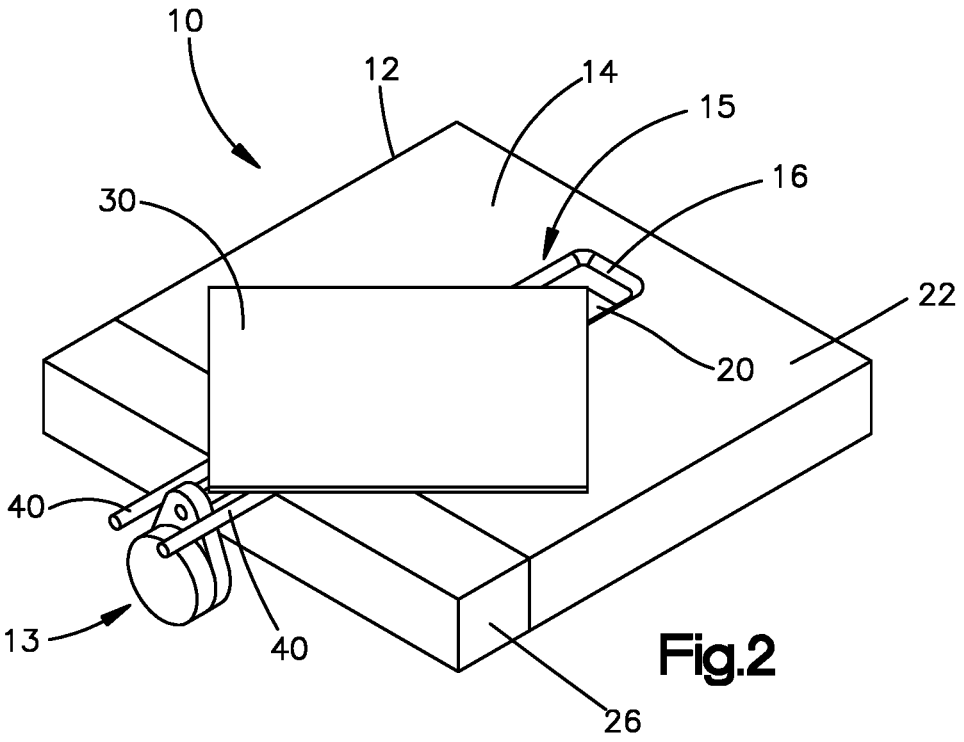
FIG. 2 is a view similar to FIG. 1, showing the apparatus in a different condition, and also showing a napkin.
Figure 3:
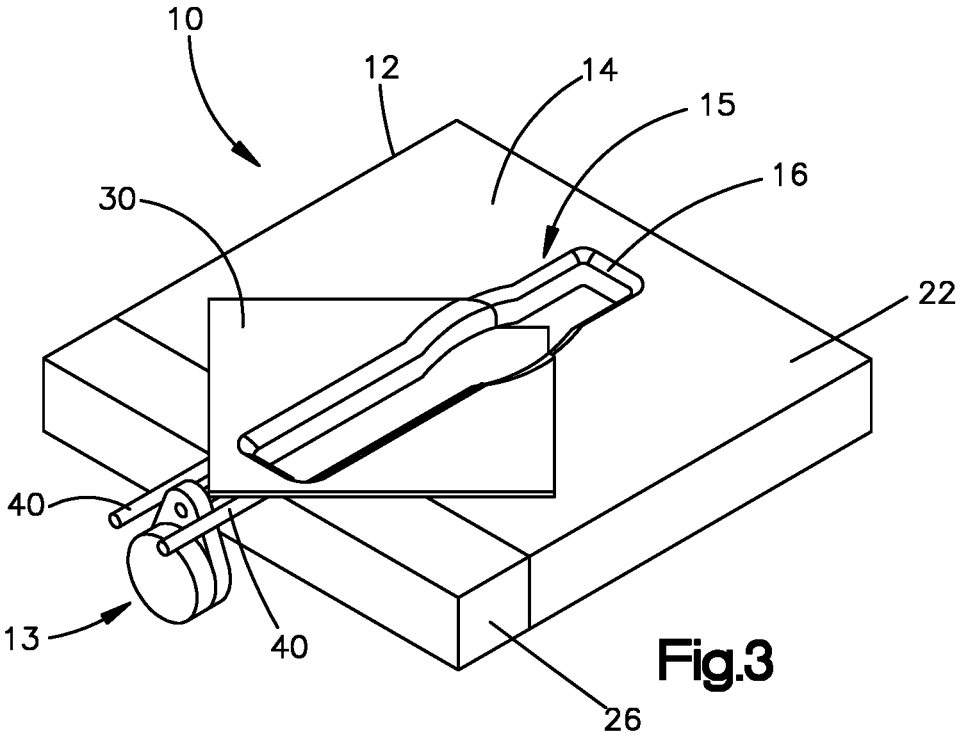
FIG. 3 is a view similar to FIG. 2, showing the napkin in a different condition.
Figure 4:
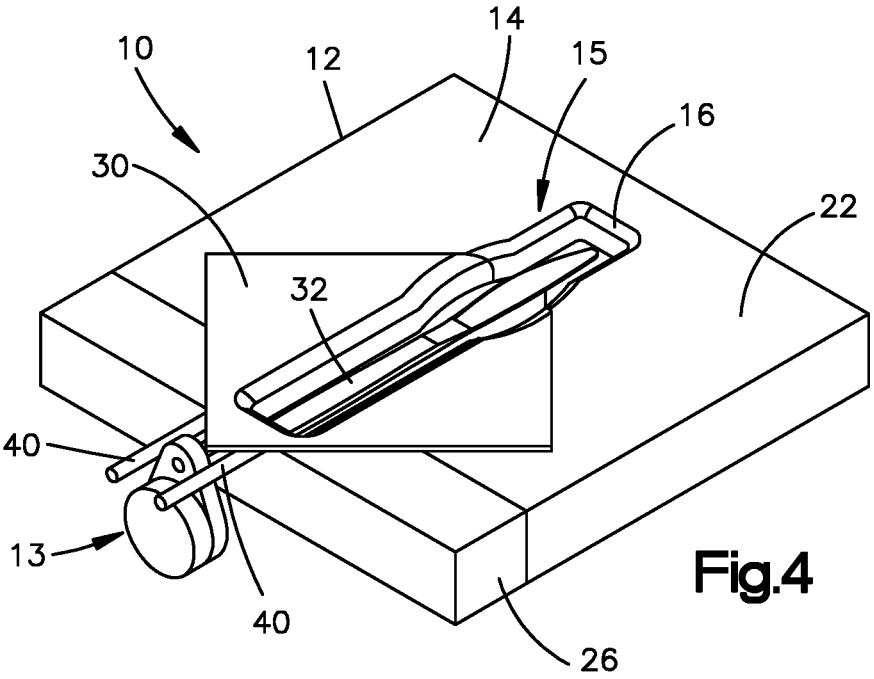
FIGS. 4, 5, and 6 are views similar to FIG. 3, showing pieces of silverware successively placed on the napkin.
Figure 5:
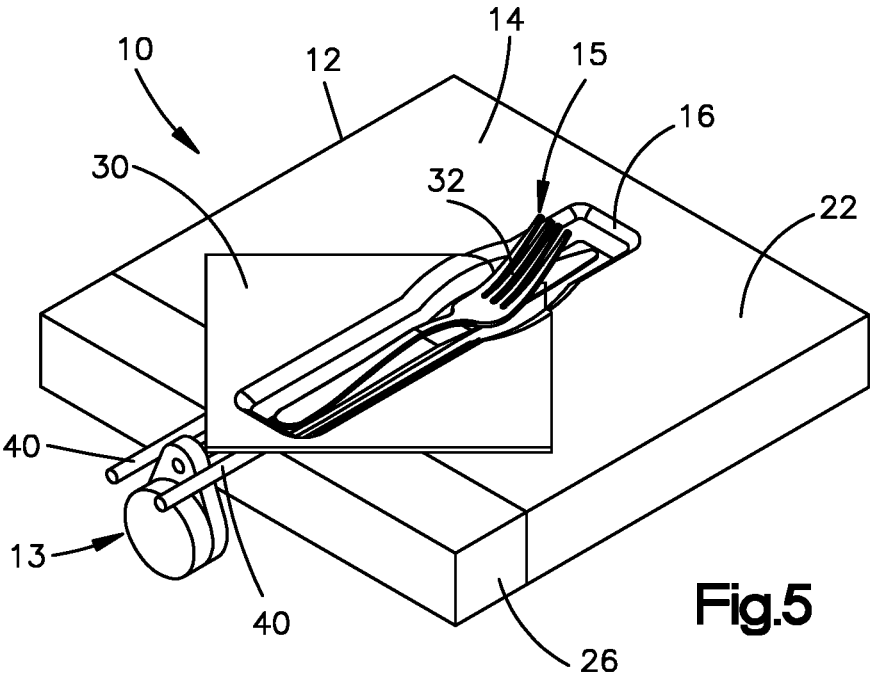
Figure 6:
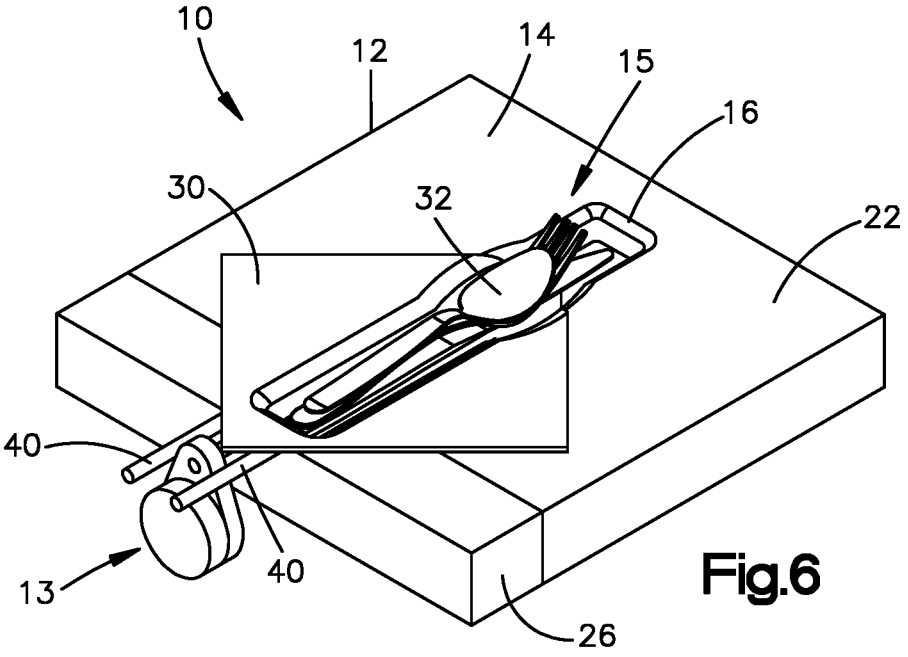

In use, a napkin 30 is placed on the upper surface 14 of the platform 12 to reach across the slot 15 as shown in FIG. 2. Vacuum pressure is applied to draw the napkin 30 into the slot 15 as shown in FIG. 3. Silverware 32 is placed over the napkin 30 in a stacked arrangement within the slot 15 as shown in FIGS. 4-6.

Figure 7:
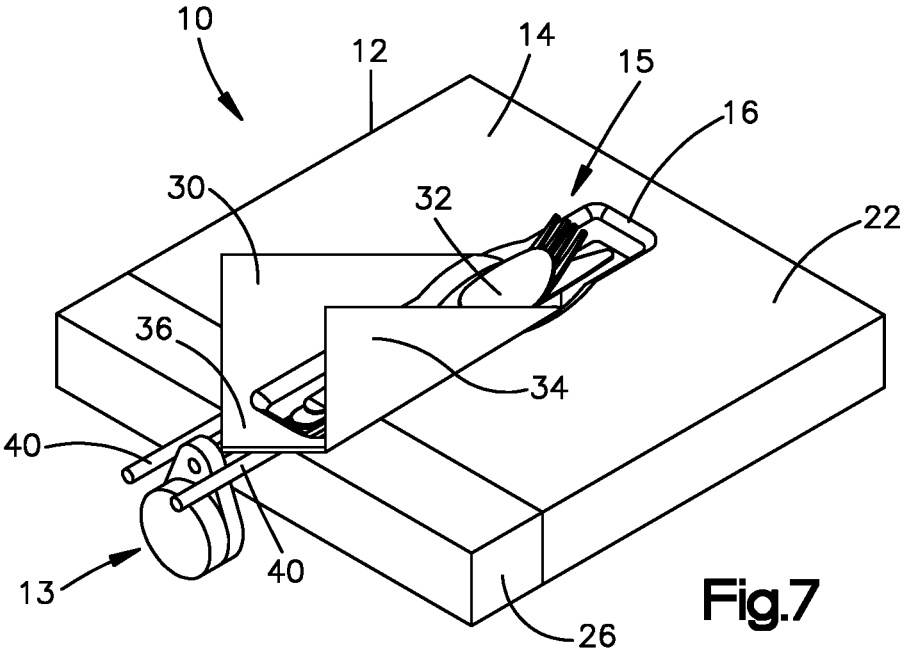
FIGS. 7 and 8 are views similar to FIGS. 4-6, showing the napkin in successive stages of folding.
Figure 8:
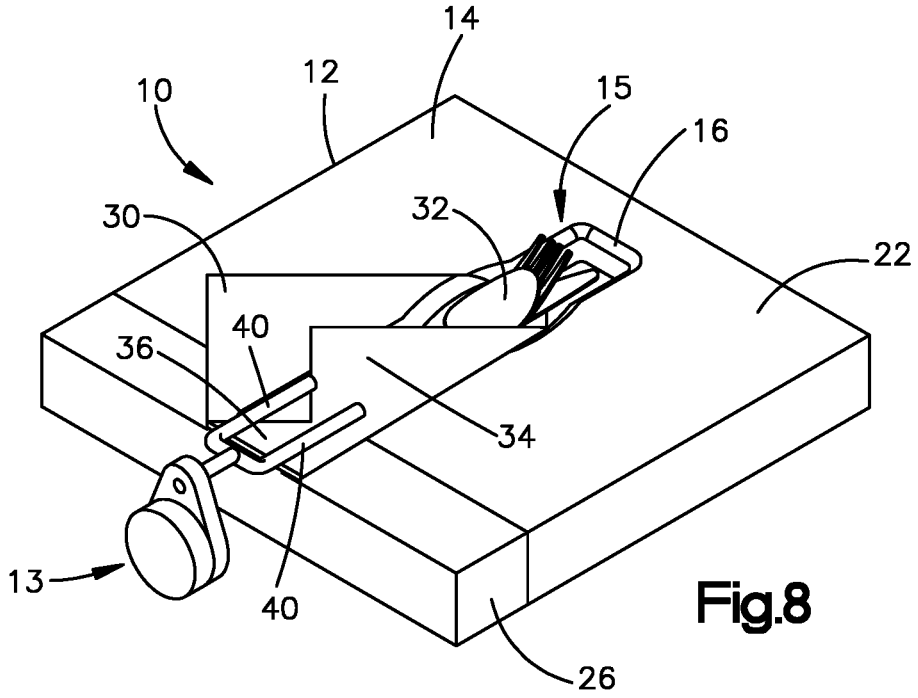

A corner portion 34 of the napkin 30 at one side of the slot 15 is folded across the silverware 32 toward the opposite side of the slot 15 as shown in FIG. 7. Another corner portion 36 of the napkin 30 at the end 18 of the slot 15 is folded lengthwise of the silverware 32 toward the opposite end 16 of the slot 15 as shown in FIG. 8. This step is performed by prongs 40 on the rolling device 13.

Figure 9:
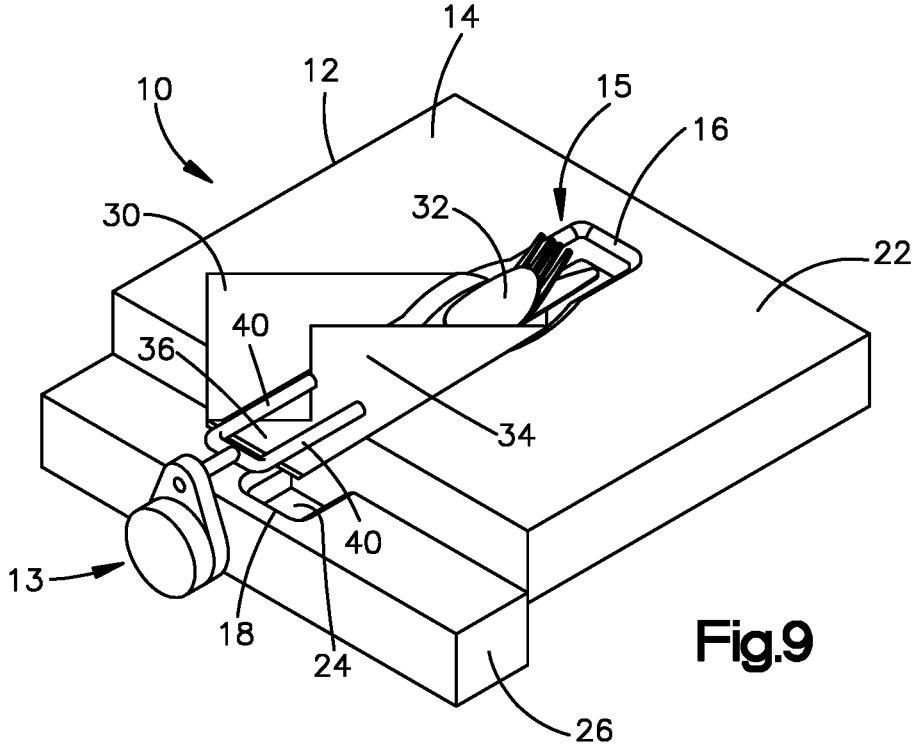
FIG. 9 is a view similar to FIG. 8, showing apparatus in a successive condition.
Figure 10:
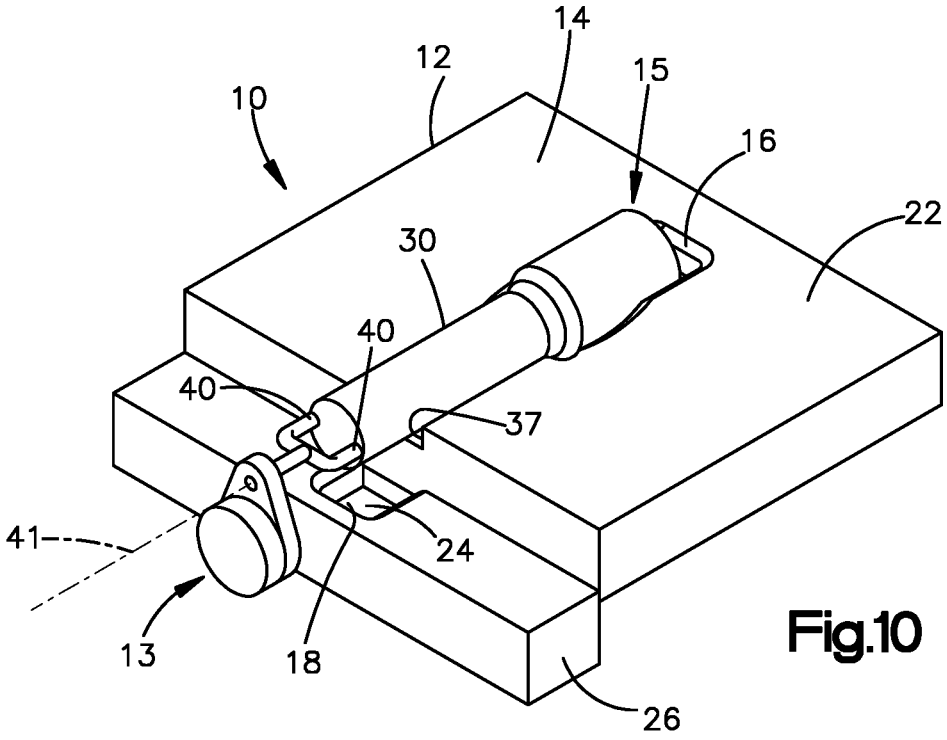
FIGS. 10-13 are views similar to FIG. 9, showing the napkin and the apparatus in successive conditions.

The second portion 26 of the platform 12 is retracted from the first portion 22 as shown in FIG. 9. This provides clearance for the rolling device 13 project inward though an open end 37 of the slot 15 to roll the napkin 30 into the configuration of FIG. 10. Specifically, the prongs 40 extend longitudinally inward of the folded napkin 30, and are rotated about an axis 41 parallel to the length of the slot 15.

Figure 11:
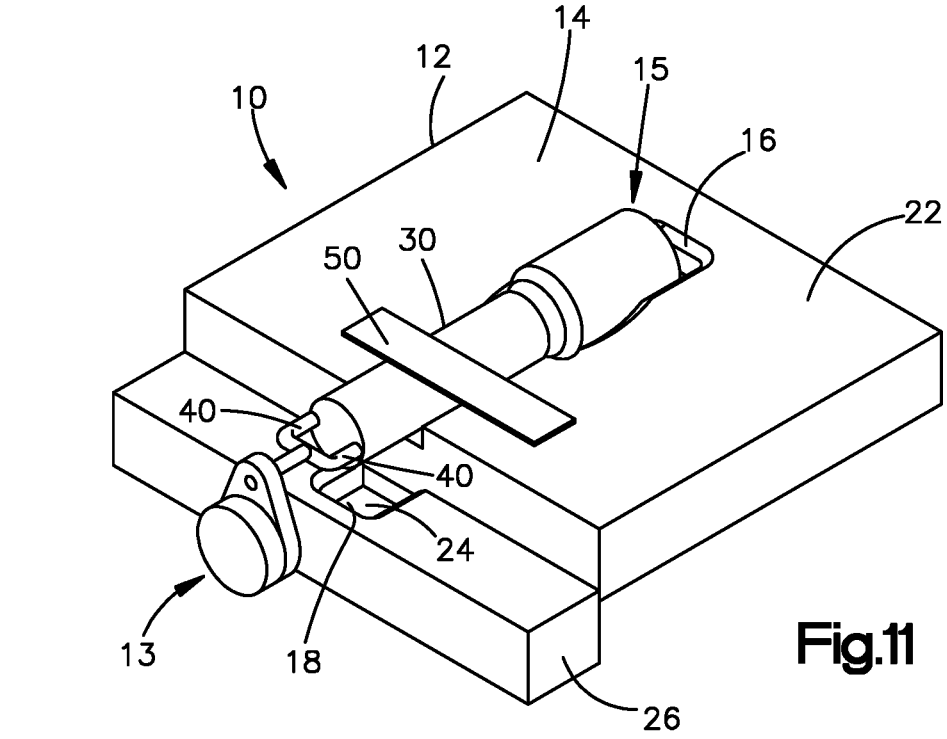
Figure 12:
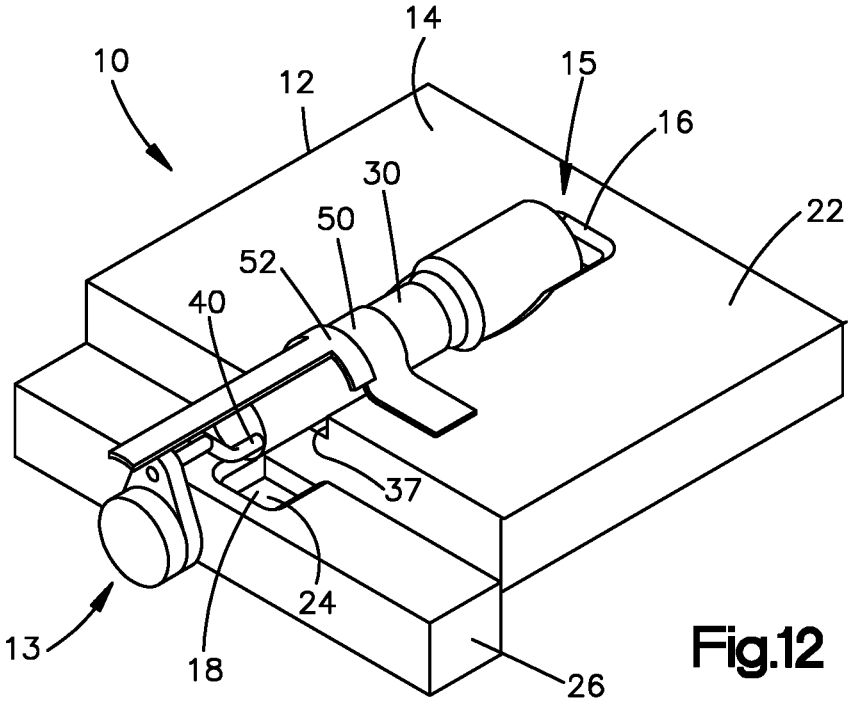
Figure 13:
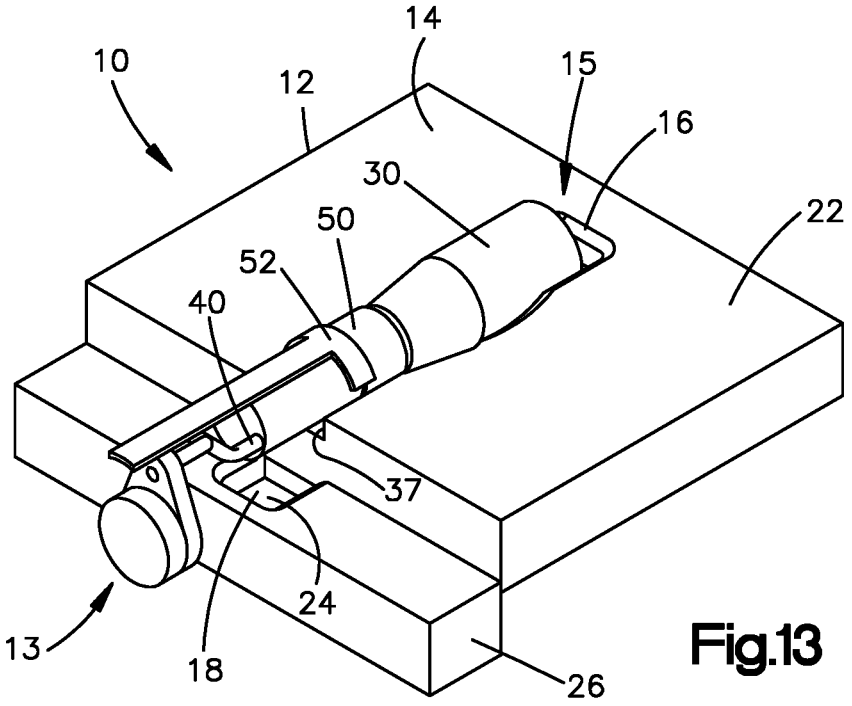

A band 50 is placed across the rolled napkin 30 as shown in FIG. 11. A clamp 52 is placed over the band 50 so that further rotation wraps the band 50 around the rolled napkin as shown in FIGS. 12 and 13. The wrapped unit 56 of silverware 32 and rolled napkin 30 can then be removed from the apparatus as shown in FIG. 1.

This written description sets forth the best mode of carrying out the invention, and describes the invention so as to enable a person of ordinary skill in the art to make and use the invention, by presenting examples of the elements recited in the claims. The detailed descriptions of those examples do not impose limitations that are not recited in the claims.

What is claimed is:

1. An apparatus comprising:

a platform having an upper surface configured to support a napkin overlying the upper surface, and having a cavity recessed from the upper surface;

means for applying vacuum pressure in the cavity to draw the napkin downward from the upper surface into the cavity; and means for rolling the napkin in the cavity;

wherein the cavity is configured to receive silverware over the napkin in the cavity;

wherein the cavity is a slot configured to receive stacked silverware over the napkin in the slot;

wherein the slot is defined by sections of the platform, and the sections of the platform are configured for movement between a closed condition, in which the slot has closed opposite ends, and an open condition, in which the slot has an open end.

2. An apparatus as defined in claim 1 wherein the means for rolling the napkin in the cavity includes means for folding a portion of the napkin over the cavity.

3. An apparatus as defined in claim 1 wherein the means for rolling the napkin in the slot has a napkin engagement portion supported for rolling movement within the open end of the slot.

4. An apparatus as defined in claim 3 wherein the napkin engagement portion includes prongs.

5. An apparatus as defined in claim 1 further comprising a clamp configured to hold a band over the napkin in the cavity.

* * * * *